US011728109B2

(12) United States Patent
Pan et al.

(10) Patent No.: US 11,728,109 B2
(45) Date of Patent: Aug. 15, 2023

(54) KEY STRUCTURE

(71) Applicant: Primax Electronics Ltd., Taipei (TW)

(72) Inventors: Yung-Tai Pan, Taipei (TW); Chun-Che Wu, Taipei (TW); Ming-Hao Hsieh, Taipei (TW); Sheng-An Tsai, Taipei (TW)

(73) Assignee: PRIMAX ELECTRONICS LTD, Taipei (TW)

( * ) Notice: Subject to any disclaimer, the term of this patent is extended or adjusted under 35 U.S.C. 154(b) by 0 days.

(21) Appl. No.: 17/851,201

(22) Filed: Jun. 28, 2022

(65) Prior Publication Data

US 2023/0215668 A1 Jul. 6, 2023

Related U.S. Application Data

(60) Provisional application No. 63/296,386, filed on Jan. 4, 2022.

(51) Int. Cl.
*H01H 13/7065* (2006.01)
*H01H 13/86* (2006.01)

(52) U.S. Cl.
CPC ..... *H01H 13/7065* (2013.01); *H01H 13/86* (2013.01); *H01H 2237/008* (2013.01)

(58) Field of Classification Search
CPC ..... H01H 3/125; H01H 13/705; H01H 13/14; H01H 13/04; H01H 13/10; H01H 13/70; H01H 13/704; H01H 13/7065; H01H 13/7006; H01H 13/7057; H01H 13/78; H01H 13/79; H01H 13/52; H01H 13/703; H01H 13/507; H01H 3/12; H01H 13/20
See application file for complete search history.

(56) References Cited

U.S. PATENT DOCUMENTS 5,258,592 A * 11/1993 Nishikawa ..... H01H 13/063 200/302.2
10,289,210 B1 * 5/2019 Wang ..... G06F 3/0445
2021/0398756 A1 * 12/2021 Nguyen ..... H04M 1/236

* cited by examiner

*Primary Examiner* — Ahmed M Saeed
(74) *Attorney, Agent, or Firm* — Kirton McConkie; Evan R. Witt

(57) ABSTRACT

A key structure includes a casing, a covering member, a pressing element, a triggering post, a switch element. The casing has an opening. The opening is covered by the covering member. The pressing element is disposed within the opening and connected with the covering member. The pressing element includes a middle part and an extension part. The triggering post is installed on the middle part of the pressing element. The triggering post is extended in the direction toward the inner position of the casing. When an external force is applied to the middle part of the pressing element, the triggering post is moved toward the switch element to push the switch element. When the external force is applied to the extension part of the pressing element, the triggering post is correspondingly moved with the pressing element in an inclined manner to push the switch element.

9 Claims, 7 Drawing Sheets

KEY STRUCTURE

CROSS-REFERENCE TO RELATED APPLICATION

This application claims priority to U.S. Provisional Patent Application No. 63/296,386 filed Jan. 4, 2022, the contents of which are incorporated herein by reference.

FIELD OF THE INVENTION

The present invention relates to an input device, and more particularly to a key structure.

BACKGROUND OF THE INVENTION

In a key structure of a conventional remote controller, a single elastic pressing element is located over a switch element. The elastic pressing element has both functions of a keycap and a triggering post. Generally, when the elastic pressing element is pressed down by the user directly, the elastic pressing element is moved downwardly to push the switch element directly. Consequently, the switch element is triggered to generate a signal. Generally, the conventional elastic pressing element is formed by integrally forming elastic plastic material or soft rubber material as a one-piece structure. Then, the elastic pressing element is installed on the remote controller.

However, the only use of the elastic pressing element to push and trigger the switch element still has some drawbacks. For example, the size of the elastic pressing element does not always match the size of the switch element. Consequently, when the elastic pressing element is pressed down by the user, the external force is possibly not applied to the middle position of the elastic pressing element that is directly located over the switch element, or the external force is possibly applied to a position of the elastic pressing element that is deviated to a periphery region of the switch element. Since the switch element is unable to be pushed by the elastic pressing element successfully, the switch element cannot be triggered to generate the signal. Moreover, since the elastic pressing element fabricated by the elastic plastic molding process, the elastic pressing element is prone to errors in size and shape, and the precision of the elastic pressing element is usually unsatisfied. Consequently, the switch element cannot be sensitively triggered by the elastic pressing element.

SUMMARY OF THE INVENTION

For solving the drawbacks of the conventional technologies, the present invention provides a key structure. The key structure includes a covering member, a pressing element and a triggering post. The pressing element and the triggering post are made of hard material. The covering member is made of soft material. The covering member is located over the pressing element to cover the pressing element. The triggering post is located under the pressing element and aligned with a switch element. When the covering member is pressed by the user, a soft tactile feel of pressing the covering member is provided, and the switch element is correspondingly pushed by the pressing element and the triggering post that are made of hard material. Moreover, the triggering post is accurately aligned with a middle region of the switch element. Even if the position of the external force applied to the pressing element is deviated, the switch element can be still pushed by the triggering post. Consequently, the sensitivity of triggering the switch element is enhanced.

In accordance with an aspect of the present invention, a key structure is provided. The key structure includes a casing, a covering member, a pressing element, a triggering post and a switch element. The casing has an opening. The opening of the casing is covered by the covering member. The pressing element is disposed within the opening of the casing and connected with the covering member. The pressing element includes a middle part and an extension part. The triggering post is installed on the middle part of the pressing element. The pressing element is protruded from the middle part of the pressing element and extended in a direction toward an inner position of the casing. The switch element is disposed within the casing and located under the triggering post. When an external force is applied to the middle part of the pressing element, the triggering post is moved toward the switch element to push the switch element. When the external force is applied to the extension part of the pressing element, the triggering post is correspondingly moved with the pressing element in an inclined manner so as to push the switch element.

In an embodiment, the triggering post includes a triggering part and a lateral part. The lateral part is arranged around the triggering part. The triggering part and the lateral part of the triggering post are aligned with the switch element. When the external force is applied to the middle part of the pressing element, the switch element is pushed by the triggering post of the triggering post. When the external force is applied to the extension part of the pressing element, the switch element is pushed by the triggering part and the lateral part of the triggering post.

In an embodiment, the triggering part of the triggering post has a first angle, and the lateral part of the triggering post has a second angle. The second angle is smaller than the first angle.

In an embodiment, the key structure further includes an elastic arm. The elastic arm is connected with the triggering post. The elastic arm is aligned with the extension part of the pressing element.

In an embodiment, the elastic arm includes a resilience part and a fixing part. The resilience part is connected with the triggering post. The resilience part of the elastic arm is in parallel with the extension part of the pressing element. The fixing part is connected with the casing.

In an embodiment, the elastic arm has a curve-shaped structure or an S-shaped structure.

In an embodiment, the pressing element has a top surface and a bottom surface. The top surface faces the covering member. The bottom surface faces the inner portion of the casing.

In an embodiment, the triggering post is protruded from the bottom surface of the pressing element at a position corresponding to the middle part of the pressing element and extended in a direction toward the inner position of the casing.

In an embodiment, the extension part of the pressing element is arranged around the middle part of the pressing element.

In an embodiment, the opening has a periphery region. The extension part of the pressing element is extended from the middle part of the pressing element and extended in a direction toward the periphery region of the opening.

In an embodiment, the key structure further includes an elastic element. The elastic element is located under the triggering post. The switch element is covered by the elastic element.

In an embodiment, the pressing element further includes a structural part, and the structural part is formed on the extension part of the pressing element.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments and accompanying drawings.

Figure 1:
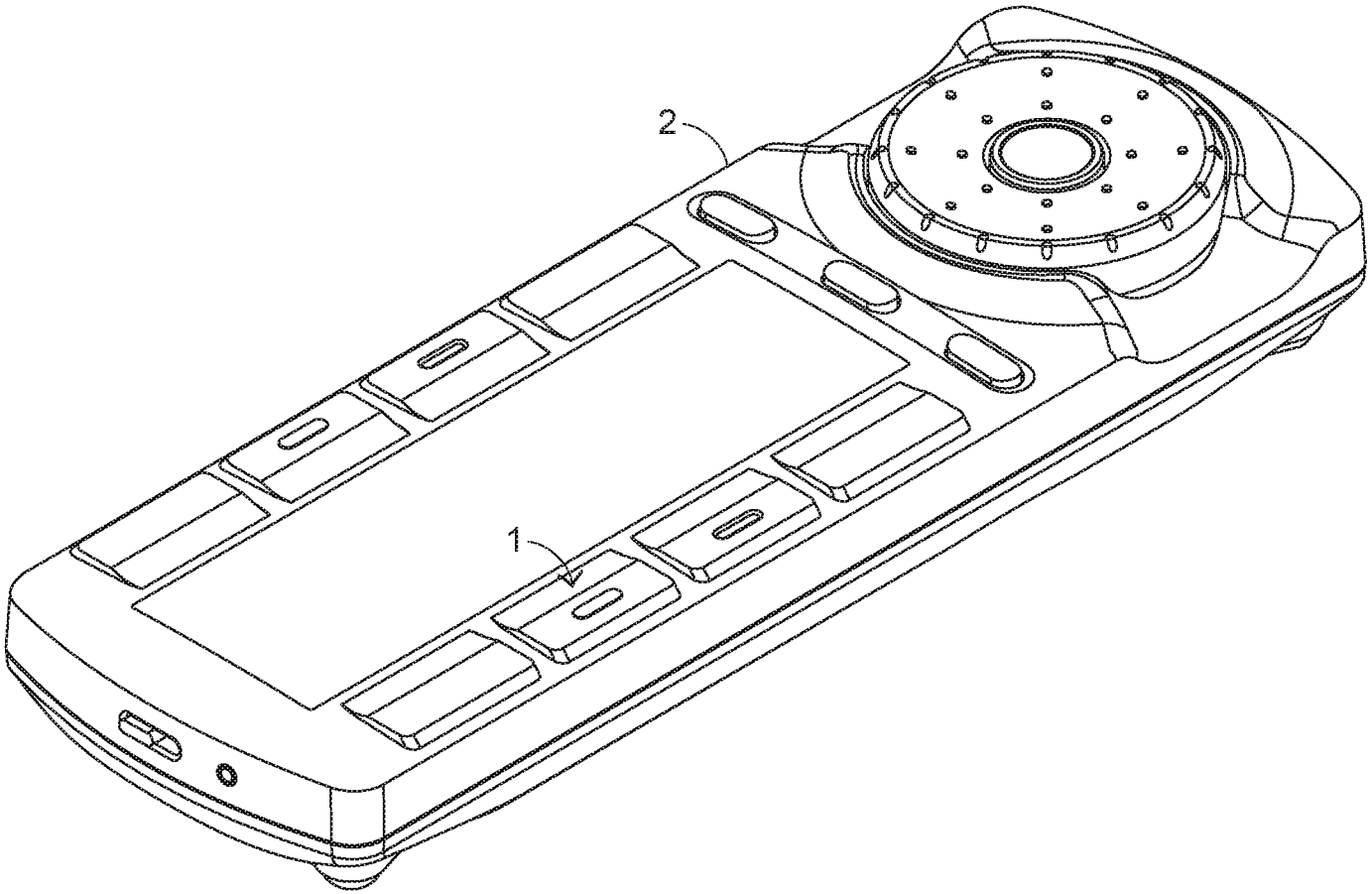
FIG. 1 is a schematic perspective view illustrating a remote controller and plural key structures according to an embodiment of the present invention.
Figure 2:
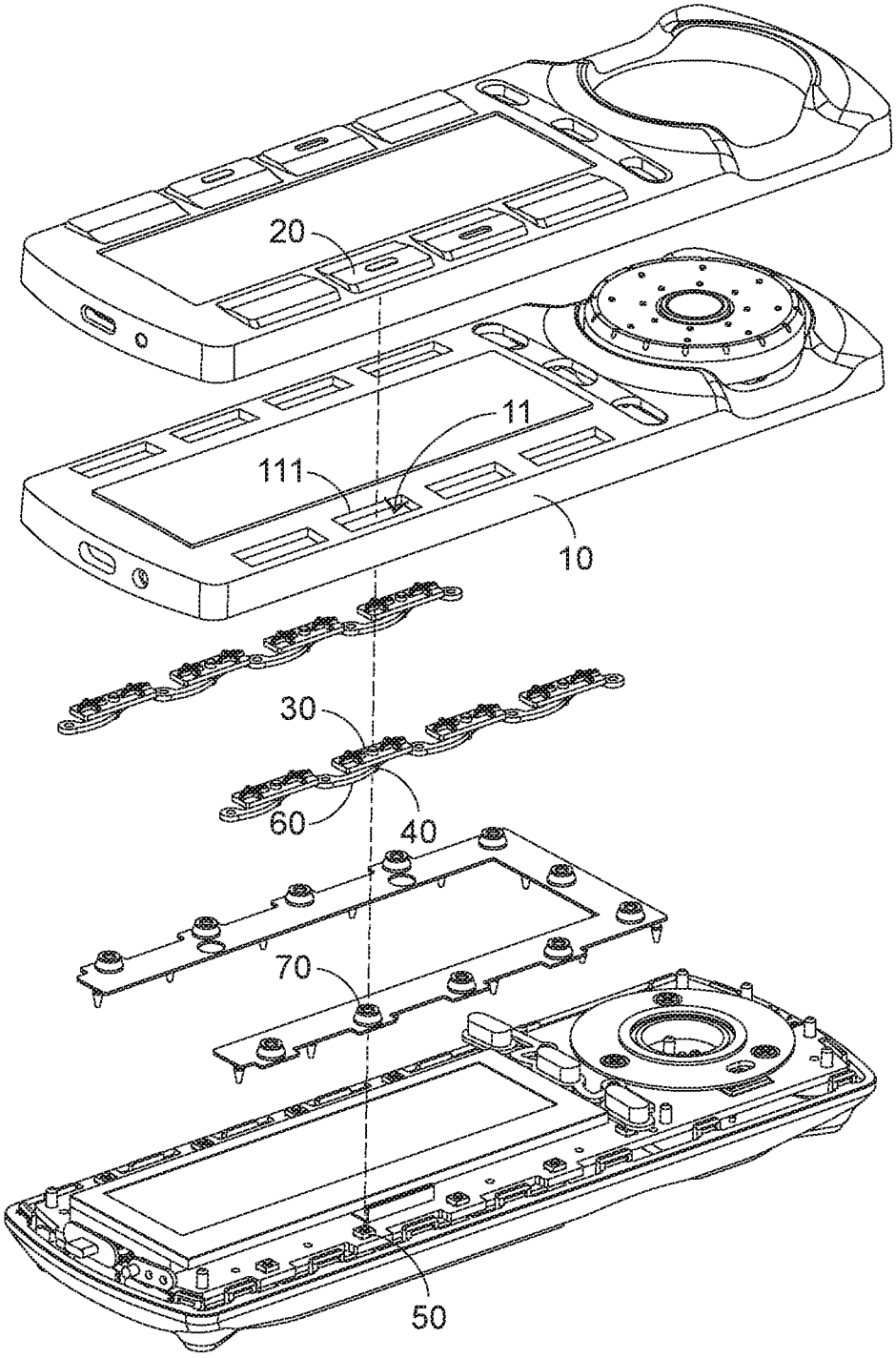
FIG. 2 is a schematic exploded view illustrating the key structures according to the embodiment of the present invention.

FIG. 1 is a schematic perspective view illustrating a remote controller and plural key structures according to an embodiment of the present invention. FIG. 2 is a schematic exploded view illustrating the key structures according to the embodiment of the present invention. The key structures 1 are installed in a remoted controller 2.

In an embodiment, the key structure 1 comprises a casing 10, a covering member 20, a pressing element 30, a triggering post 40, a switch element 50, an elastic arm 60 and an elastic element 70. The casing 10 of the key structure 1 has an opening 11. The covering member 20 is located over the opening 11 to cover the opening 11. Preferably, the entire of the casing 10 and the opening 11 are covered by the covering member 20. The pressing element 30 is disposed within the opening 11 of the casing 10 and connected with the covering member 20. The triggering post 40 is disposed within the casing 10 and installed on the pressing element 30. The switch element 50 is disposed within the casing 10 and located under the triggering post 40. The elastic arm 60 is disposed within the casing 10. In addition, the elastic arm 60 is connected with the triggering post 40 and the casing 10. The elastic element 70 is located under the triggering post 40. In addition, the switch element 50 is covered by the elastic element 70.

Figure 3:
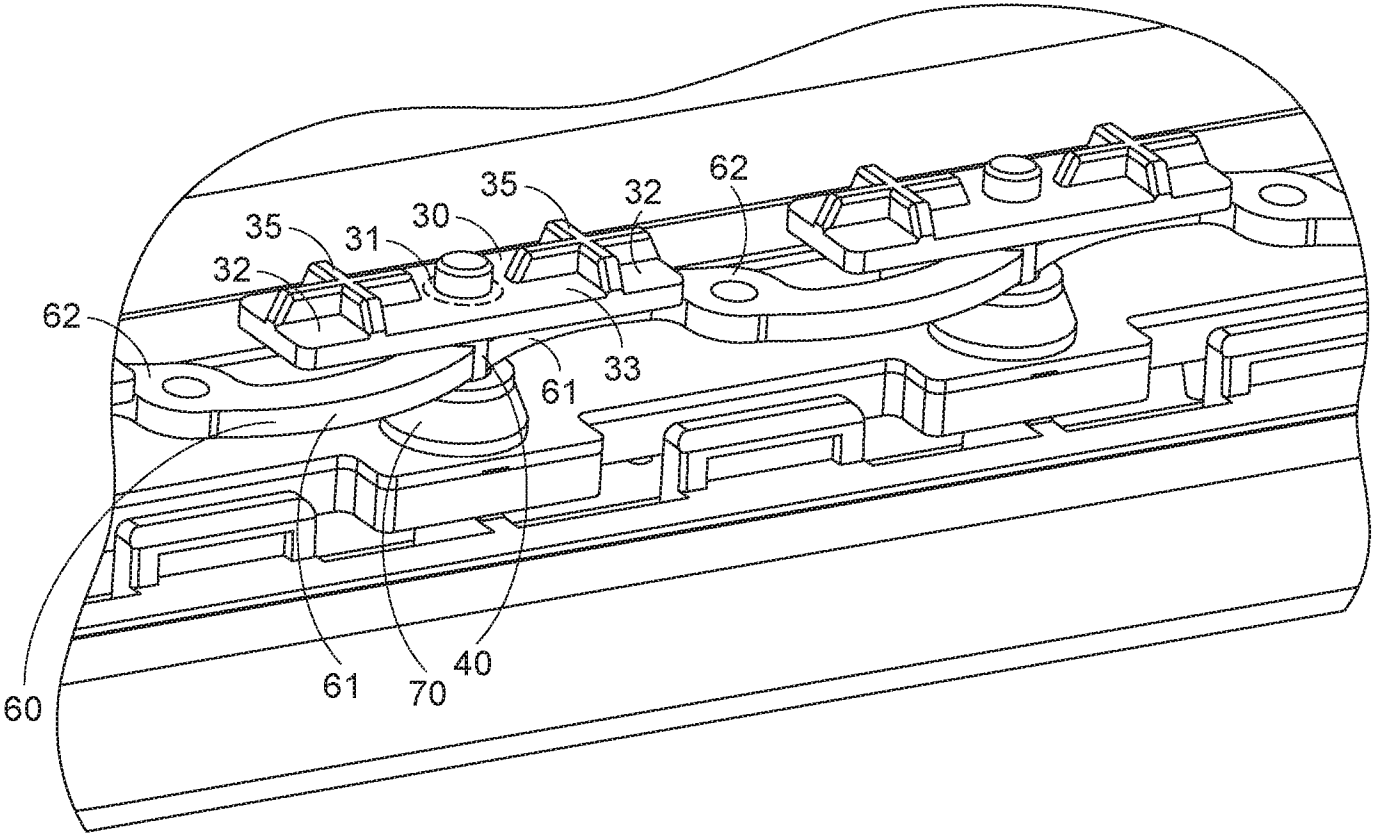
FIG. 3 is a schematic perspective view illustrating a portion of the key structure of the remote controller according to the embodiment of the present invention.
Figure 4:
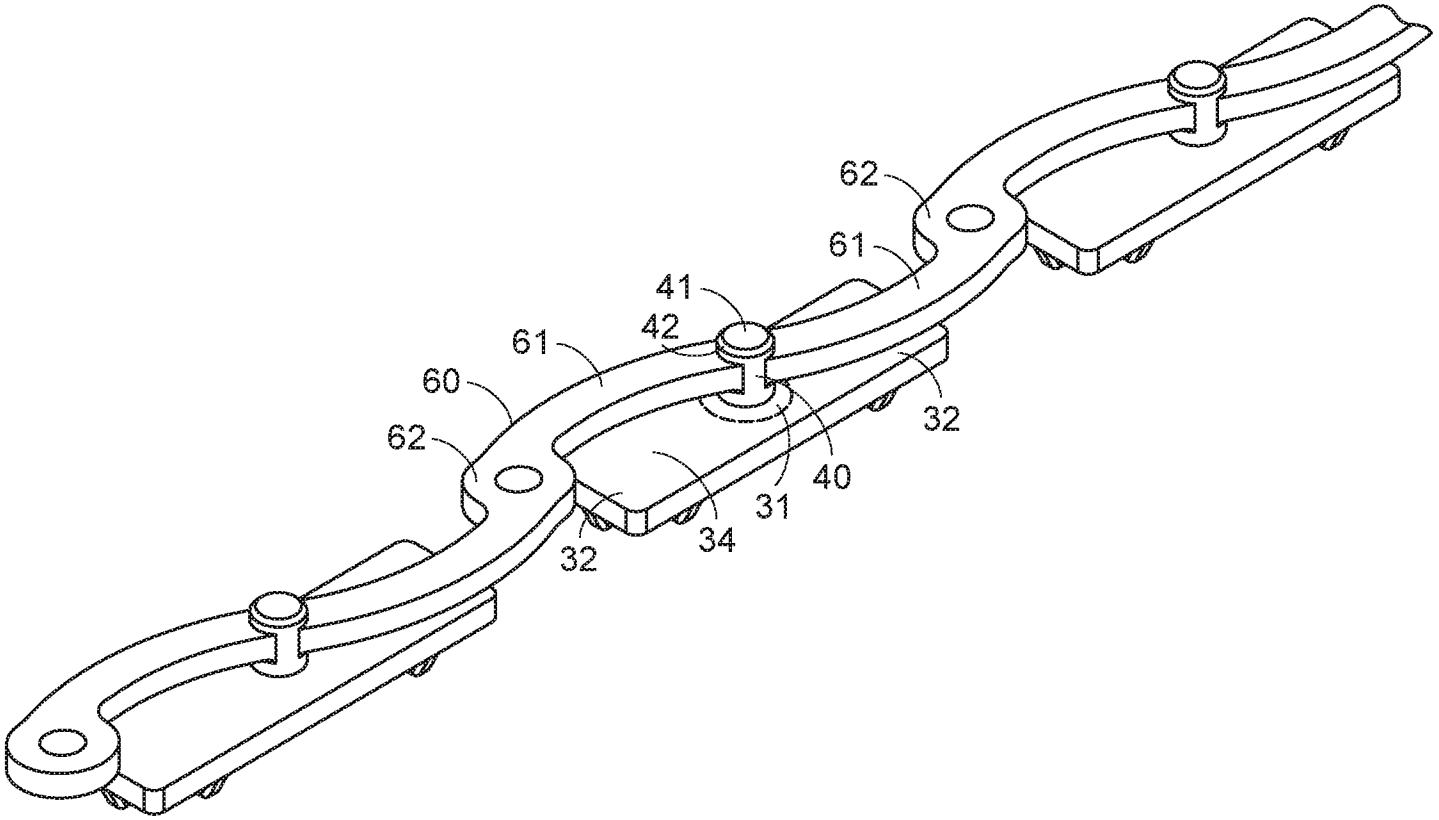
FIG. 4 is a schematic perspective view illustrating a portion of the key structure of the remote controller according to the embodiment of the present invention.
Figure 5:
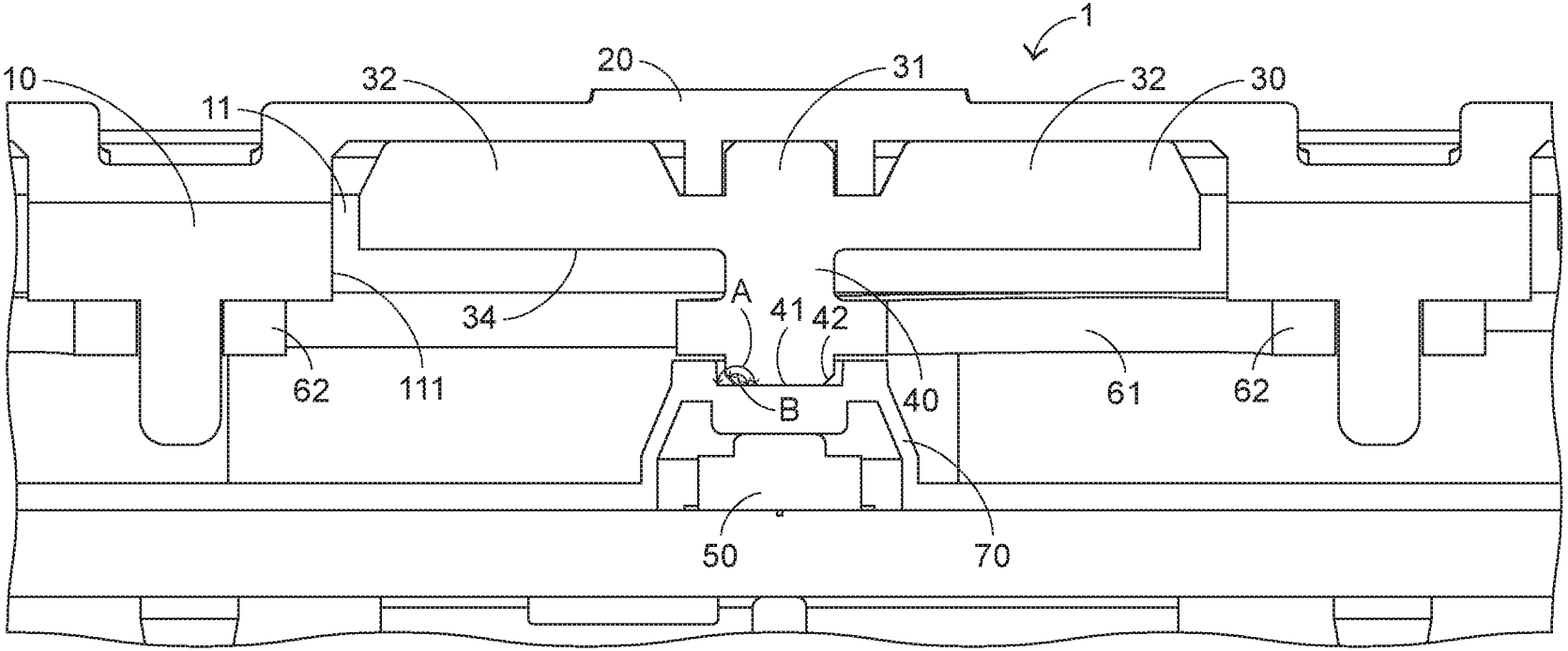
FIG. 5 is a schematic cross-sectional view illustrating a portion of the key structure of the remote controller according to the embodiment of the present invention.
Figure 6:
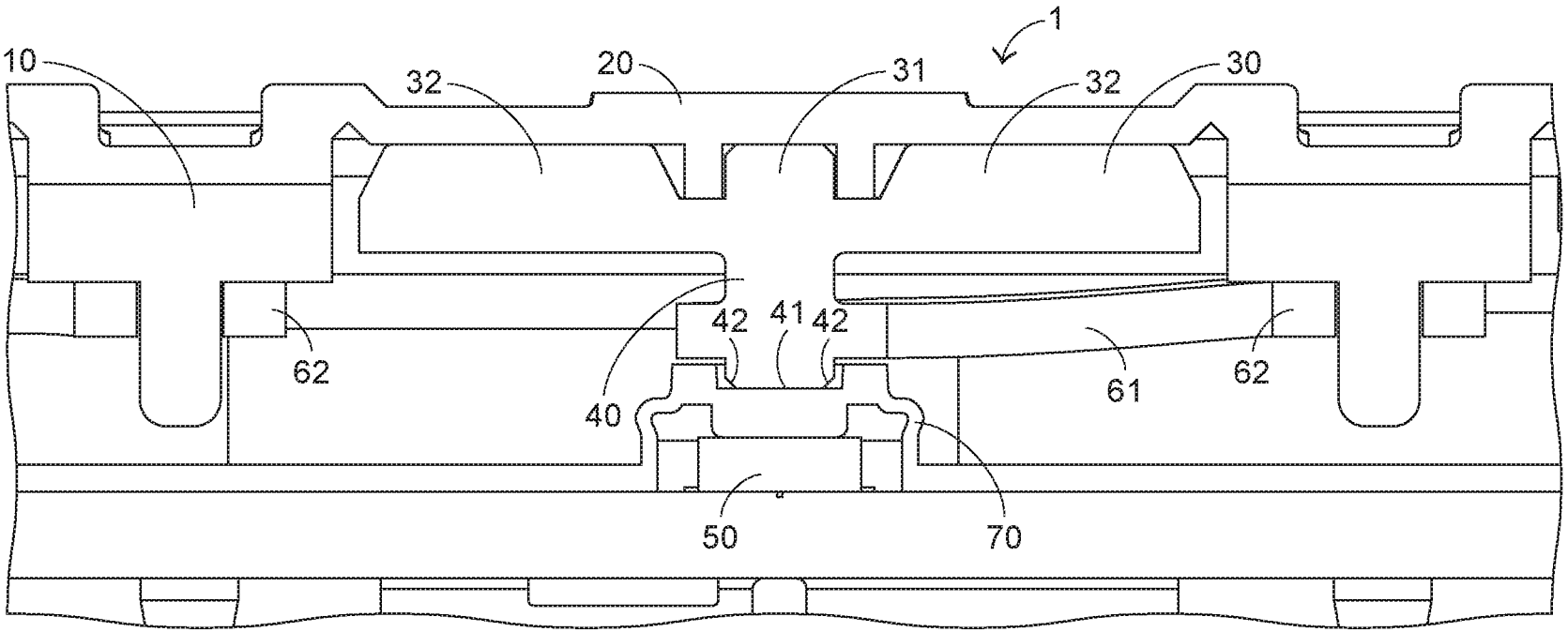
FIG. 6 is a schematic cross-sectional view illustrating a portion of the key structure of the remote controller according to the embodiment of the present invention, in which an external force is applied to the middle part of the pressing element of the key structure.
Figure 7:
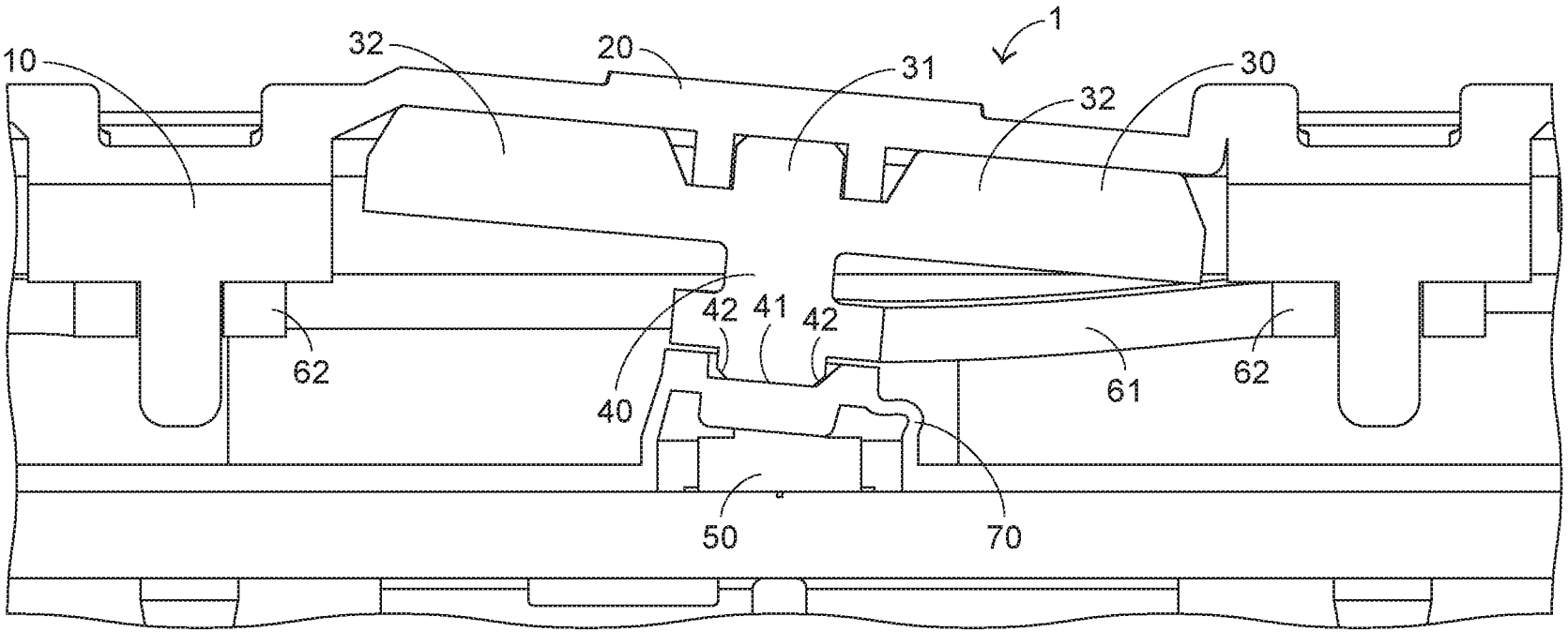
FIG. 7 is a schematic cross-sectional view illustrating a portion of the key structure of the remote controller according to the embodiment of the present invention, in which an external force is continuously applied to the extension part of the pressing element of the key structure.

The structure and the operations of the key structure 1 will be described in more details as follows. FIG. 3 is a schematic perspective view illustrating a portion of the key structure of the remote controller according to the embodiment of the present invention. FIG. 4 is a schematic perspective view illustrating a portion of the key structure of the remote controller according to the embodiment of the present invention. FIG. 5 is a schematic cross-sectional view illustrating a portion of the key structure of the remote controller according to the embodiment of the present invention. FIG. 6 is a schematic cross-sectional view illustrating a portion of the key structure of the remote controller according to the embodiment of the present invention, in which an external force is applied to the middle part of the pressing element of the key structure. FIG. 7 is a schematic cross-sectional view illustrating a portion of the key structure of the remote controller according to the embodiment of the present invention, in which an external force is applied to the extension part of the pressing element of the key structure.

The opening 11 of the casing 10 has a periphery region 111. The pressing element 30 comprises a middle part 31, an extension part 32, a top surface 33, a bottom surface 34 and a structural part 35. The triggering post 40 comprises a triggering part 41 and a lateral part 42. The elastic arm 60 comprises a resilience part 61 and at least one fixing part 62.

Please refer to FIGS. 2, 3 and 4. The pressing element 30 is disposed within the opening 11 of the casing 10. The top surface 33 of the pressing element 30 faces the covering member 20. The bottom surface 34 of the pressing element 30 faces the inner portion of the casing 10. The extension part 32 of the pressing element 30 is arranged around the middle part 31 of the pressing element 30. In addition, the extension part 32 is extended from the middle part 31 of the pressing element 30 and extended in the direction toward the periphery region 111 of the opening 11. Consequently, the shape of the extension part 32 of the pressing element 30 matches the shape of the opening 11 of the casing 10. The structural part 35 is formed on the top surface 33 of the pressing element 30 and aligned with the extension part 32. The structural part 35 is connected with the covering member 20. Due to the structural part 35, the weight of the extension part 32 is increased. Consequently, when the pressing element 30 is pressed down at various angles, the extension part 32 can be inclined more easily.

The triggering post 40 is installed on the middle part 31 of the pressing element 30. The triggering post 40 is protruded from the bottom surface 34 of the pressing element 30 at a position corresponding to the middle part 31 and extended in the direction toward the inner position of the casing 10. The lateral part 42 of the triggering post 40 is arranged around the triggering part 41 of the triggering post 40. Moreover, the lateral part 42 and the triggering part 41 of the triggering post 40 are aligned with the switch element 50.

Please refer to FIG. 5 again. The triggering part 41 of the triggering post 40 has a first angle A. The lateral part 42 of the triggering post 40 has a second angle B. The second angle B of the lateral part 42 is smaller than the first angle A of the triggering part 41. Preferably, the first angle A of the triggering part 41 is 180 degrees, and the second angle B of the lateral part 42 is in the range between 145 degrees and 170 degrees.

When an external force is applied to the middle part 31 of the pressing element 30, the triggering post 40 is moved toward the switch element 50 along the vertical direction. Consequently, the triggering part 41 of the triggering post 40 is moved downwardly to push the switch element 50 in a non-inclined manner.

When the external force is applied to the extension part 32 of the pressing element 30, the triggering post 40 is correspondingly moved with the pressing element 30 in an inclined manner. The lateral part 42 of the triggering post 40 is aligned with the switch element 50 at the second angle B. Moreover, when the triggering post 40 is moved in the inclined manner, the switch element 50 is pushed by the lateral part 42 and a portion of the triggering part 41. In other words, when the triggering post 40 is moved in the inclined manner, the lateral part 42 assists the triggering part 41 in pushing the switch element 50. Since the area of the triggering post 40 to push the switch element 50 is increased, the switch element 50 can be triggered more easily.

Please refer to FIGS. 3 and 4 again. The elastic arm 60 is connected with the triggering post 40. Moreover, the elastic arm 60 is aligned with the extension part 32 of the pressing element 30. Particularly, the resilience part 61 of the elastic arm 60 is connected with the triggering post 40, and the resilience part 61 of the elastic arm 60 is in parallel with the extension part 32 of the pressing element 30. The at least one fixing part 62 of the elastic arm 60 is connected with the casing 10. The at least one fixing part 62 of the elastic arm 60 comprises one or plural fixing parts 62. In this embodiment, the at least one fixing part 62 of the elastic arm 60 comprises two fixing parts 62. After the at least one fixing part 62 of the elastic arm 60 is connected with the casing 10, the elastic arm 60 is positioned in the inner portion of the casing 10. The resilience part 61 of the elastic arm 60 is extended from the fixing part 62 and extended in the direction toward the triggering post 40. In addition, the resilience part 61 is connected with the triggering post 40. The resilience part 61 of the elastic arm 60 provides an elastic property. When the triggering post 40 is pressed down, the elastic property of the resilience part 61 of the elastic arm 60 assists the triggering post 40 in pushing the switch element 50 and assists the switch element 50 in elastically returning back to its original position. In an embodiment, the elastic arm 60 has a curve-shaped structure or an S-shaped structure. Since the elastic arm 60 has the curve-shaped structure or the S-shaped structure, the length of the elastic arm 60 can be expanded in the narrow space. As the length of the elastic arm 60 is increased, the elastic arm 60 can undergo the elastic bending action more stably and precisely, and the action range can be increased. Moreover, due to the curve-shaped structure or the S-shaped structure, the elastic arm 60 can be bent at different angles.

The elastic element 70 is arranged between the triggering post 40 and the switch element 50. Due to the elastic element 70, the motion of the triggering post 40 is buffered. That is, the arrangement of the elastic element 70 can prevent the triggering post 40 from excessively rubbing against the switch element 50. Moreover, the arrangement of the elastic element 70 can assist the triggering post 40 in pushing and triggering the switch element 50 in diverse directions.

The actions and the structure of the key structure 1 after being pressed down will be described with reference to FIGS. 6 and 7.

Please refer to FIG. 6. When an external force is applied to the middle part 31 of the pressing element 30, the triggering post 40 is moved in the direction toward the switch element 50, and the resilience part 61 of the elastic arm 60 is bent in the direction toward the switch element 50. At the same time, the triggering part 41 of the triggering post 40 is aligned with the elastic element 70 and the switch element 50, and the triggering part 41 of the triggering post 40 is moved downwardly to push the elastic element 70 and the switch element 50. Consequently, the switch element 50 is triggered to generate a switching signal (not shown).

Please refer to FIG. 7. When an external force is applied to the extension part 32 of the pressing element 30, the triggering post 40 is correspondingly moved with the pressing element 30 in an inclined manner. Consequently, the resilience part 61 of the elastic arm 60 is not only bent in the direction toward the switch element 50 but also bent in the direction of the external force in the inclined manner. The resilience part 61 of the elastic arm 60 can assist the triggering post 40 to be moved in the inclined manner. In other words, the triggering part 41 and the lateral part 42 of the triggering post 40 are both aligned with the elastic element 70 and the switch element 50, and the triggering part 41 and the lateral part 42 of the triggering post 40 are moved downwardly to push the elastic element 70 and the switch element 50. Consequently, the switch element 50 is triggered to generate a switching signal (not shown). That is, even if the triggering post 40 is moved in the inclined manner, the switch element 50 can still be pushed by the triggering post 40 through the lateral part 42. Consequently, the area of the triggering post 40 to push the switch element 50 is increased.

From the above descriptions, the key structure 1 is specially designed. Even if the external force is not applied to the middle position of the key structure 1 that is directly located over the switch element 50, or even if the external force is applied to a position of the key structure 1 that is deviated from a periphery region of the switch element 50, the triggering post 40 is correspondingly moved with the pressing element 30 in an inclined manner. Consequently, both of the triggering part 41 and the lateral part 42 of the triggering post 40 can be moved downwardly to push the switch element 50.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A key structure, comprising:

a casing, wherein the casing has an opening;

a covering member, wherein the opening of the casing is covered by the covering member;

a pressing element disposed within the opening of the casing and connected with the covering member, wherein the pressing element includes a middle part and an extension part;

a triggering post installed on the middle part of the pressing element, wherein the triggering post is protruded from the middle part of the pressing element and extended in a direction toward an inner position of the casing; and a switch element disposed within the casing and located under the triggering post, wherein when an external force is applied to the middle part of the pressing element, the triggering post is moved toward the switch element to push the switch element, wherein when the external force is applied to the extension part of the pressing element, the triggering post is correspondingly moved with the pressing element in an inclined manner so as to push the switch element, wherein the key structure further comprises an elastic arm, the elastic arm is connected with the triggering post and the elastic arm is aligned with the extension part of the pressing element, the elastic arm comprises a resilience part and a fixing part, the resilience part is connected with the triggering post, the resilience part of the elastic arm is in parallel with the extension part of the pressing element, and the fixing part is connected with the casing, the elastic arm has an S-shaped structure.

2. The key structure according to claim 1, wherein the triggering post comprises a triggering part and a lateral part, wherein the lateral part is arranged around the triggering part, and the triggering part and the lateral part of the triggering post are aligned with the switch element, wherein when the external force is applied to the middle part of the pressing element, the switch element is pushed by the triggering post of the triggering post, wherein when the external force is applied to the extension part of the pressing element, the switch element is pushed by the triggering part and the lateral part of the triggering post.

3. The key structure according to claim 2, wherein the triggering part of the triggering post has a first angle, and the lateral part of the triggering post has a second angle, wherein the second angle is smaller than the first angle.

4. The key structure according to claim 1, wherein the pressing element has a top surface and a bottom surface, wherein the top surface faces the covering member, and the bottom surface faces the inner portion of the casing.

5. The key structure according to claim 4, wherein the triggering post is protruded from the bottom surface of the pressing element at a position corresponding to the middle part of the pressing element and extended in a direction toward the inner position of the casing.

6. The key structure according to claim 1, wherein the extension part of the pressing element is arranged around the middle part of the pressing element.

7. The key structure according to claim 1, wherein the opening has a periphery region, wherein the extension part of the pressing element is extended from the middle part of the pressing element and extended in a direction toward the periphery region of the opening.

8. The key structure according to claim 1, wherein the key structure further comprises an elastic element, wherein the elastic element is located under the triggering post, and the switch element is covered by the elastic element.

9. The key structure according to claim 1, wherein the pressing element further comprises a structural part, and the structural part is formed on the extension part of the pressing element.

* * * * *